United States Patent [19]

Mitamura et al.

[11] Patent Number: 4,969,395

[45] Date of Patent: Nov. 13, 1990

[54] INKING APPARATUS FOR USE IN PRINTING MACHINES

[75] Inventors: Mitsuru Mitamura, Yokohama; Tsutomu Ito, Atsugi, both of Japan

[73] Assignee: Toshiba Kikai Kabushiki Kaisha, Tokyo, Japan

[21] Appl. No.: 399,414

[22] Filed: Aug. 25, 1989

Related U.S. Application Data

[63] Continuation of Ser. No. 165,707, Mar. 8, 1988, abandoned.

[30] Foreign Application Priority Data

Mar. 9, 1987 [JP] Japan ..... 62-53427

[51] Int. Cl.[5] ..... B41F 31/04; B41F 31/06; B41L 27/08

[52] U.S. Cl. ..... 101/365

[58] Field of Search ..... 101/350, 365, 363, 364, 101/207, 208–210, 366, 148; 118/259, 261, 258

[56] References Cited

U.S. PATENT DOCUMENTS 4,366,754 1/1983 Sarda ..... 101/208

*Primary Examiner*—J. Reed Fisher

*Attorney, Agent, or Firm*—Cushman, Darby & Cushman

[57] ABSTRACT

In an inking apparatus for use in a printing machine having an ink pot and a plurality of juxtaposed ink metering keys and adjusting means for moving the ink metering keys toward and away from the peripheral surface of an inking roller in contact with the ink contained in the ink pot, there are provided center supporting keys on both sides of the ink metering key located at the axial center of the inking roller, and adjusting means for reciprocating the center supporting keys toward and away from the periphery of the inking roller independently of the ink metering keys.

3 Claims, 3 Drawing Sheets

INKING APPARATUS FOR USE IN PRINTING MACHINES

BACKGROUND OF THE INVENTION

This is a continuation of application Ser. No. 07/165,707, filed Mar. 8, 1988 which was abandoned upon the filing hererof.

This invention relates to inking apparatus for use in a printing machine, and more particularly an improved inking apparatus capable of forming an ink film of uniform thickness.

In a conventional off-set printing machine, the viscosity of the printing ink is relatively high, for example, 300–1000 centipoise (that of water is 1 centipoise) so that an inking roller deflects due to the reaction pressure of an ink film flowing through a gap between the surface of the inking roller and the tips of a plurality of juxtaposed ink metering keys. Consequently, the thickness of the ink film becomes nonuniform in the axial direction of the inking roller, thus resulting in printed matters of poor quality.

To have a better understanding of this invention a typical prior art inking apparatus will firstly be described with reference to FIG. 6. As shown, the prior art inking device comprises an inking roller 11, a pair of longitudinally spaced side plates 14 urged against the end surfaces of the roller to form an ink pot 17 together with the peripheral surface of the inking roller 11 and an inclined plate 15, and a shoe 56 urged against the central portion of the peripheral surface of the inking roller for supporting the central portion thereof, these members being supported by a hollow beam 21 moved toward and away from the inking roller 11 by a pressure applying device 51 supported by a base 12. Ink metering keys 18 are mounted on the hollow base 21 at a position above the shoe 56. A plurality of ink metering keys 18 are juxtaposed in the longitudinal direction of inking roller 11 and operated by a motor driven mechanism 20 for adjusting the width of the gap between the tips of the keys 18 and the roller. The pressure applying device 51 in the form of a feed screw is provided at the center of beam 21 at a position between the base 12 supporting the inking roller 11 and the mechanism 20 for operating the ink metering keys 18 for deflexing the beam 21 whereby the inking roller 11 is flexed by the shoe 56 so as to apply a pressure to the inking roller. The pressure applied to the ink metering keys 18 applied by the mechanism 20 is made slightly larger than the reaction force applied to the tips of the keys 18 by an ink film so as to ensure a constant thickness of the ink film. With this construction, however, the center shoe cannot be moved toward and away from the inking roller unless the pressure applying device 51 is operated, so that the ink film passed through the gap between the ink metering keys and the peripheral surface of the inking roller 11 would be scraped off from the inking roller so that an ink lump P would be formed at the inlet of the shoe. Consequently, this lump P tends to make unstable the thickness of the ink film formed on the peripheral surface of the inking roller 11.

SUMMARY OF THE INVENTION

Accordingly, it is an object of this invention to provide an improved inking apparatus for use in a printing machine capable of forming an ink film of a uniform thickness by substituting the central shoe with center supporting keys of improved construction.

According to this invention, there is provided inking apparatus for use in a printing machine comprising: a plurality of ink metering keys juxtaposed along an inking roller; means for reciprocating the ink metering keys toward and away from the peripheral surface of the inking roller for adjusting a thickness of a printing ink film formed between the ink metering keys and the peripheral surface; a base member for rotatably supporting the inking roller; a beam disposed in parallel with the inking roller, the beam having supporting members operatively coupled to opposite ends of the inking roller; an ink pot constituted by a bottom plate having an inclined surface inclined toward the inking roller, a pair of side plates secured to opposite ends of the bottom plate to form slide contacts to opposite ends of the inking cylinder, and the peripheral surface of the inking roller; a plurality of center supporting keys provided at an axially central portion of the inking roller; means supported by the base member and mounted at a central portion thereof for urging a central portion of the beam toward the inking roller; and means for finely reciprocating the center supporting keys relative to the beam toward and away from the periphery of the inking roller independently of the ink metering keys and independently of the beam.

DESCRIPTION OF THE PREFERRED EMBODIMENT

Figure 1:
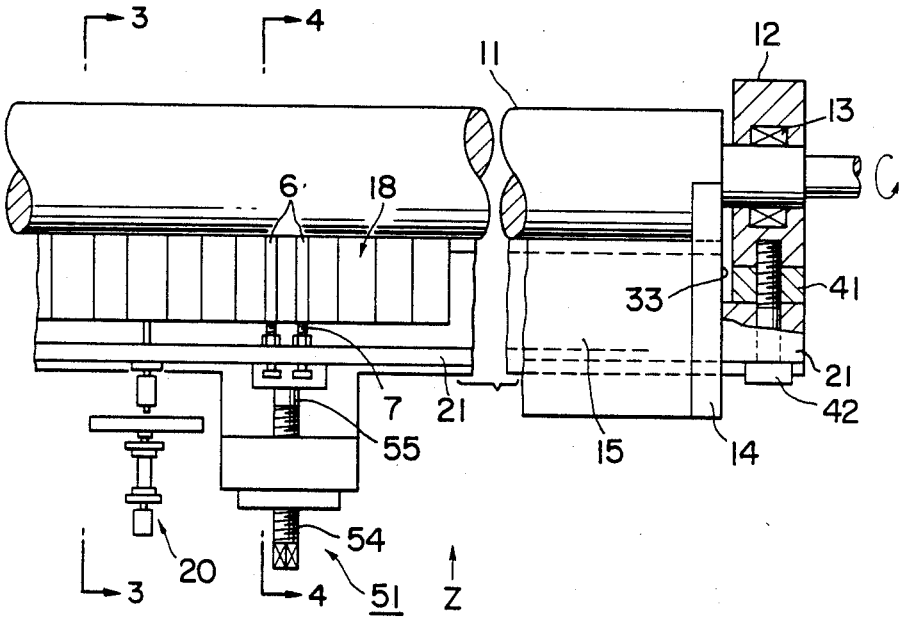
FIG. 1 is a plan view showing one embodiment of the inking apparatus according to this invention.

A preferred embodiment of this invention will now be described with reference to FIGS. 1 to 5. As shown in FIG. 1, an inking roller 11 is rotatably supported by bearings 13 supported by a base 12, and driven by a source of drive, not shown. On one side of the inking roller 11 is formed an ink pot 17 formed by a pair of side plates 14 slidably urged against the end surfaces of the inking roller 11 and an inclined bottom plate 15. As best shown in FIG. 3, the upper surface of each ink metering key 18 is held in contact with the bottom surface of the inclined bottom plate 15, the forward tip of each ink metering key being spaced a little from the peripheral surface of the inking roller 11 to permit ink 17 in the ink pot 16 to flow out as a thin ink film.

Figure 2:
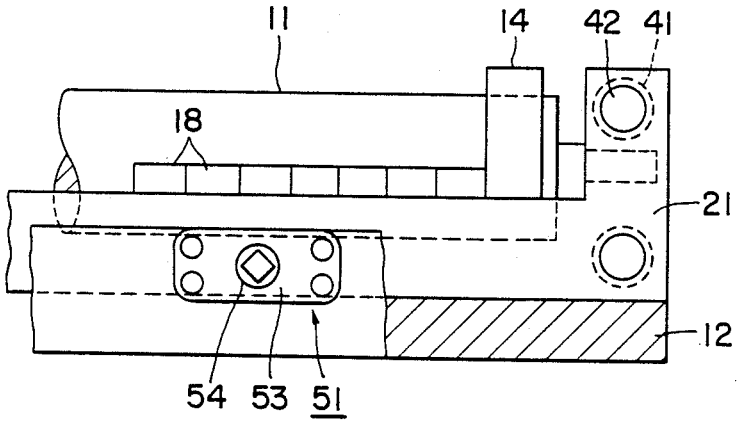
FIG. 2 is a side view of the apparatus shown in FIG. 1 as viewed in the direction of arrow Z.
Figure 3:
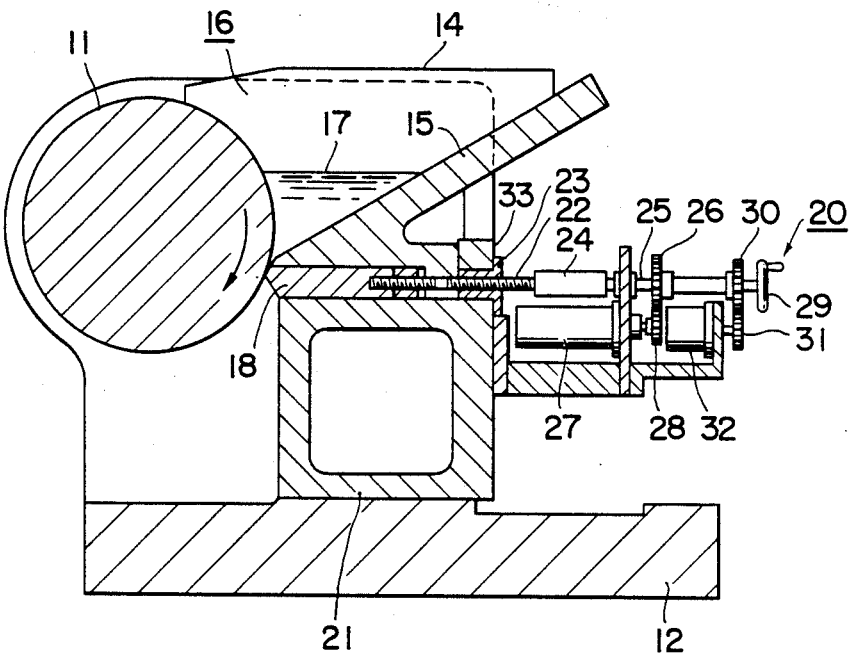
FIG. 3 is a sectional view taken along a line III—III in FIG. 1.

As shown in FIG. 2, a plurality of ink metering keys 18 are juxtaposed in the axial direction of the inking roller 11. The movement of each ink metering key 18 toward and away from the inking roller 11 is effected by an adjusting mechanism 20 shown in FIG. 3. More particularly, the adjusting mechanism 20 is secured to a hollow beam 21 which is mounted on the base 12, as described more fully below. A screw threaded rod 22 is threaded to the righthand end of each ink metering key 18 and mated with nut 23 mounted on the beam 21. The screw threads of the rod 22 and nut 23 have the same direction but have slightly different pitches, thus forming a differential screw for finely adjusting the ink metering keys.

The adjusting threaded rod 22 is coupled to a shaft 25 through a coupling 24. A gear 26 connected to the shaft 25 meshes with a pinion 28 driven by an electric motor 27 for reciprocating the ink metering key 18. The shaft 25 can also be rotated by a handle 29, thus permitting manual adjustment. A potentiometer 32 is connected to shaft 25 through gears 30 and 31 so as to detect the amount of movement of the ink metering key 28. The right end surface of beam 21 is used as a reference surface 33 for fabricating the keys 18.

Figure 4:
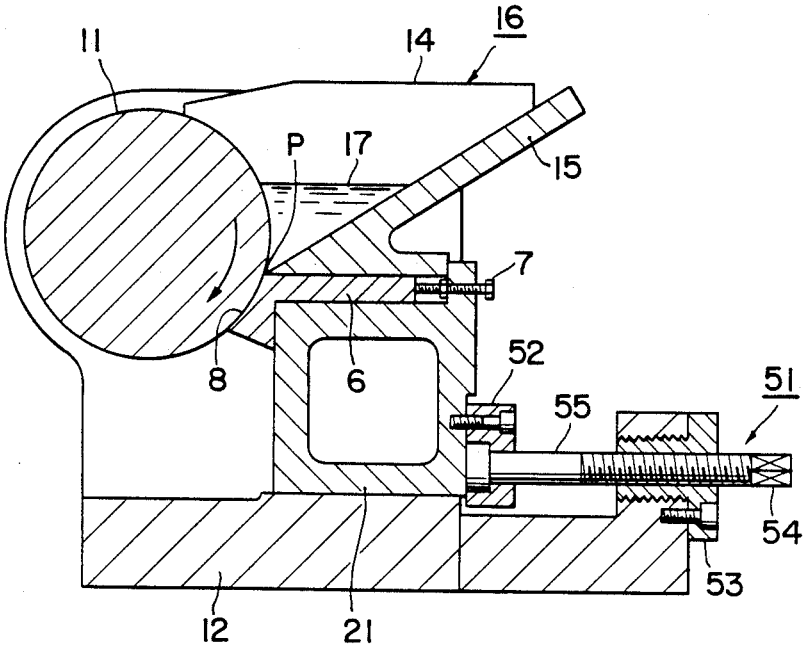
FIG. 4 is a sectional view taken along a line IV—IV in FIG. 1.

As shown in FIG. 1, the opposite ends of beam 21 are coupled to the base 12 adjacent bearings 13 through bolts 42 and adjusting spacers 41. The central portion of beam 21 is not fixed to base 12 and, therefore, is slidable relative to base 12 when flexed, as described below. Furthermore, as shown in FIG. 3, threaded portion 22 of each ink metering key 18 extends through nuts 23 supported on the beam 21. Although the beam 21 is caused to flex by the reaction force applied to the ink metering keys, such flexture is compensated for by varying the thickness of the adjusting spacers 41. Further, as shown in FIG. 4, a press mechanism 51 is provided at the central portion of beam 21 for urging the beam 21 toward the inking roller 11. The press mechanism 51 is constituted by a nut 53 secured to base 21 and a threaded rod 55 mating with nut 53, with one end connected to beam 21 through clamping plate 52 and a shunk 54 at the other end. Consequently, as the threaded rod 55 is rotated by grasping shunk 54, the inking roller 11 is pressed through the beam 21, while at the same time the ink metering keys 18 are urged against the inking roller 11 for adjusting the thickness of the ink film. In other words, when the thickness of the ink film is adjusted the inking roller itself is also accurately adjusted. Furthermore, as shown in FIGS. 1 and 4, the inking metering keys 18 are juxtaposed, and between adjacent keys 18 at the axial center of the inking roller 11 are provided two center supporting keys 6 at the same level as the ink metering keys 18. The keys 6 have concave surface 8 of the same radius of curvature as that of the peripheral surface of the inking roller for slidably supporting the central portion of the inking roller 11. These keys 6 are finely adjusted by bolts 7 threaded into the upper edge of the beam 21 as shown in FIG. 4. The width of each key 6 is narrower than that of the ink metering key 8 as shown in FIG. 1.

Figure 5:
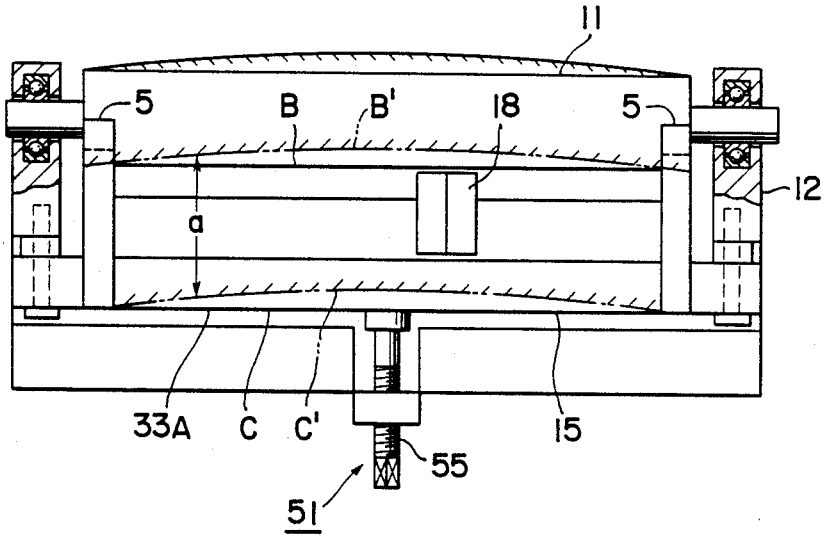
FIG. 5 is a diagrammatic plan view useful to explain the operation of a press mechanism of the inking apparatus shown in FIG. 1.

The apparatus described above operates as follows:

The threaded rod 55 of the press mechanism 51 is advanced toward the inking roller 11. Then the rear surface of the center of beam 21 flexes from position C to dotted line position C′ as shown in FIG. 5. Front surface of beam 21 flexes in the same manner as the central portion of the beam 21 slides relative to base 12. As the inking roller 11 is pressed by the center supporting keys 6 by operating the press mechanism 51, the rear surface of the inking roller 11 flexes from position B to dotted line position B′. The configurations and dimensions of various portions are selected such that the distance a between positions B′ and C′ would be equal along the axial length of the inking roller 11 whereby the distances between the reference surface 33 and the inner edges of respective keys 18 are made equal.

Further, when fine adjusting mechanism including bolt 7 is operated, the inking roller 11 is also pressed by the center supporting keys 6, thus applying a prepressure to the inking roller 11. Since this prepressure applied by the fine adjusting mechanism 51 is made larger than the reactive force applied to the keys by the thickness of the ink, it is possible to absorb the reactive force by the prepressure.

While the inking roller 11 is flexed to apply thereto a predetermined prepressure, the adjusting screw rod 22 is rotated by the fine adjusting mechanism 20 for abutting the inner ends of the keys 18 to the surface of the inking roller 11 so that the zero point can be measured and displayed by the potentiometer 32. With this adjustment it is possible to ensure uniform gaps between the inner ends of respective ink metering keys and the surface of the inking roller, thus enabling simple and accurate adjustment of the zero point.

With the inking apparatus described above, even when the inking roller is caused to flex by the pressure of the printing ink which is generated when the gaps between the tips of the ink metering keys and the inking roller is decreased, the gap can be maintained at a constant value by the fine adjusting mechanism 20 thereby enabling the zero point adjustment of the ink film. Thus, it is possible to ensure correct adjustment of the ink film thickness commensurate with the picture pattern to be printed.

Figure 6:
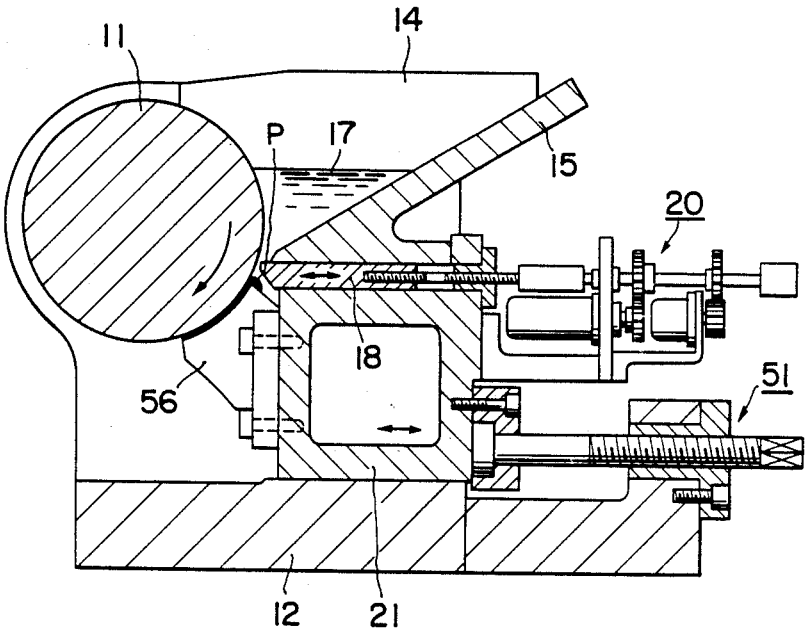
FIG. 6 PRIOR ART
FIG. 6 is a sectional view showing one example of a prior art inking apparatus.

Since, according to this invention, the center supporting keys 6 are provided at the axial center of the inking roller and are constructed to be adjustable, a predetermined thickness of the ink film can be obtained without forming an ink lump as in the prior art construction shown in FIG. 6.

What is claimed is:

1. Inking apparatus for use in a printing machine comprising:

an inking roller having first and second longitudinal ends;

a base member for rotatably supporting said inking roller;

a beam member having first and second longitudinal ends fixedly coupled to said base member, said beam member having a longitudinal axis disposed in parallel to a longitudinal axis of said inking roller, a central portion of said beam member being slidable relative to said base member when said central portion of said beam member is flexed relative to said base member;

a plurality of ink metering keys disposed along said inking roller;

means for reciprocating said ink metering keys toward and away from a peripheral surface of said inking roller for adjusting a thickness of a printing ink film formed between said ink metering keys and said peripheral surface;

an ink pot defined by a bottom plate having an inclined surface inclined toward said inking roller, a pair of side plates secured to opposite ends of said bottom plate for forming slide contacts with said first and second longitudinal ends of said inking roller, and said peripheral surface of said inking roller;

at least one center supporting key provided at an axially central portion of said inking roller for supporting said central portion of said inking roller and for applying a prepressure to said inking roller, each said center supporting key being disposed at the same vertical level as said ink metering keys, each said center supporting key having a width less than a width of each of said ink metering keys each said center supporting key having a concave surface having the same radius of curvature as said peripheral surface of said inking roller and having a surface area greater than a surface area of an end of one of said ink metering keys which is in facing relation to said peripheral surface;

means coupled to said base member for urging a central portion of said beam member toward said peripheral surface of said inking roller; and means for finely adjusting each said center supporting key relative to said beam member independently of said ink metering keys.

2. The inking apparatus according to claim 1 wherein a plurality of center supporting keys spaced from each other in an axially direction of said inking roller are provided.

3. The inking apparatus according to claim 1, wherein said base member rotatably supports said inking roller with bearings and said member is fixedly coupled to said base member adjacent said bearings.

* * * * *